United States Patent [19]

Olson et al.

[11] 4,124,980

[45] Nov. 14, 1978

[54] MULTI-ENGINE CONTROL SYSTEM PROVIDING EQUALIZED TORQUE FOR DRIVING A COMMON LOAD

[75] Inventors: Paul E. Olson; Michael D. Lyons, both of Lexington, Ky.

[73] Assignee: American Standard Inc., New York, N.Y.

[21] Appl. No.: 842,181

[22] Filed: Oct. 14, 1977

[51] Int. Cl.[2] ..... F01B 21/00; F02D 25/02

[52] U.S. Cl. ..... 60/700; 60/701; 60/702; 60/39.28 P

[58] Field of Search ..... 60/39.15, 39.28 P, 700, 60/701, 702, 716; 91/170 R

[56] References Cited

U.S. PATENT DOCUMENTS

| | | | |
|---|---|---|---|
| 2,782,601 | 2/1957 | Hamilton | 60/702 |
| 3,174,284 | 3/1965 | McCarthy | 60/39.15 X |
| 3,986,363 | 10/1976 | Beaman et al. | 60/700 |

*Primary Examiner*—Edgar W. Geoghegan
*Attorney, Agent, or Firm*—R. W. McIntire, Jr.

[57] ABSTRACT

An electronic control module comprising an operational amplifier used as a comparator senses the difference between the throttle settings of a master and slave engine as detected by a potentiometer associated with each engine's throttle control apparatus in order to accordingly adjust the control signal of a fluid pressure actuator of the slave engine, which actuator in turn adjusts the slave engine throttle setting until it corresponds to that of the master engine, at which point the slave engine throttle actuator control signal is maintained constant by reason of the operational amplifier sensing such correspondence. The electronic control module thus makes it possible to match the slave engine throttle setting to the master engine throttle setting before the master engine speed responds to the adjusted throttle setting, as reflected by its speed governor, thereby assuring that the subsequent speed governor influence on the master engine throttle setting is not reflected in the slave engine throttle setting. Accordingly, each engine governor regulates the respective engine speed with changes in load such that when the engines are arranged to drive a common load, equal torque is exerted by each engine irrespective of different engine response characteristics.

8 Claims, 1 Drawing Figure

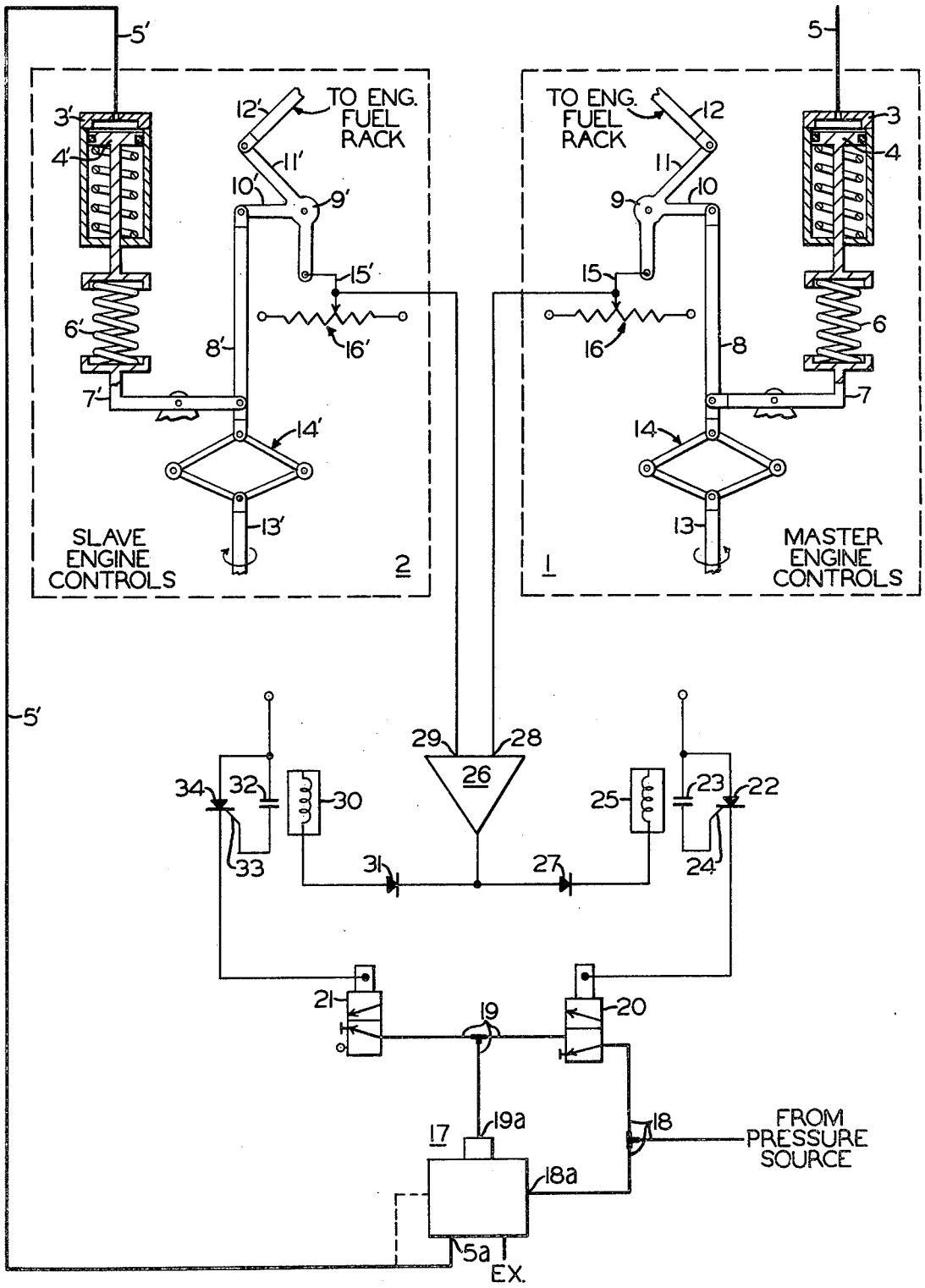
5'
5
TO ENG. FUEL RACK
TO ENG. FUEL RACK
3'
4'
12'
11'
10'
9'
15'
16'
6'
8'
7'
14'
13'
SLAVE ENGINE CONTROLS
2
12
11
10
9
15
16
8
3
4
6
7
14
13
1
MASTER ENGINE CONTROLS
29
28
26
34
32
30
33
31
27
25
23
22
24
21
19
20
17
19a
18
18a
FROM PRESSURE SOURCE
5a
EX.

MULTI-ENGINE CONTROL SYSTEM PROVIDING EQUALIZED TORQUE FOR DRIVING A COMMON LOAD

BACKGROUND OF THE INVENTION

The present invention is concerned with control systems for multiple engine operation and particularly to such systems in which a common load is driven by the respective engines.

Such multi-engine control systems are widely used throughout the marine industry for the purpose of powering a ship's drive propeller with the desired torque. In a typical installation, an actuator device is operated in accordance with a speed signal to adjust the fuel rack setting of the respective engines of a multi-set installation via the engine speed governor, which, in turn, influences the fuel rack setting as the respective engine speed changes with load variations. Because of the many variables affecting the respective engines, it is not unusual for one engine to display a totally different response characteristic than the other engine, such that the one engine tends to pull the entire load while the other engine loafs. This disproportionate engine operation in which the one engine is overworked results in excessive maintenance being required and consequently a shortened service life.

SUMMARY OF THE INVENTION

It is accordingly the object of the present invention to provide a new multi-engine control system in which the work of the respective engines in driving a common load is substantially equalized irrespective of the different engine response characteristics.

In accomplishing this objective, there is provided an electronic control circuit for comparing the fuel rack settings of a pair of engines arranged to drive a common load, one engine being designated as the master unit and the other the slave unit. The throttle actuator device of the slave engine is then operated in accordance with the difference between the master and slave engine fuel rack settings so that the speed of the slave engine is substantially the same as the speed of the master engine, which is controlled in accordance with the setting of its fuel rack by a speed control signal supplied to the master engine throttle actuator. A speed governor associated with each engine further regulates the fuel rack settings according to the varying load conditions.

BRIEF DESCRIPTION OF THE DRAWING

The above object and other advantages of the invention will become apparent from the following description and operation of the single FIGURE drawing showing a diagrammatic view of the control system comprising the present invention.

DESCRIPTION AND OPERATION

The basic engine control system enclosed within the dashed blocks 1 and 2 shows identical arrangements for controlling operation of a pair of engines, as for example marine engines that drive a ship's propeller through a common drive shaft (not shown), such an arrangement being conventional. Block 1 may be considered as containing the master engine control apparatus, while block 2 may be designated as the slave engine control apparatus, it being understood that for practical considerations, as noted in the Summary, each of the respective engines should share equally in driving the load.

The master engine control apparatus comprises a fluid pressure motor 3 having a piston 4 to which compressed air is connected via a conduit 5 at a pressure selected in accordance with the desired engine speed. A control spring 6 is engaged at its one end by piston 4 and at the opposite end by a lever 7 that is in turn connected to a control rod 8. A rotary member 9 includes an arm 10 that is connected to one end of rod 8 and another arm 11 to which the engine throttle or fuel rack is connected by a link 12. Interposed between the other end of rod 8 and a link 13 driven by the engine output shaft (not shown) is a conventional flyball type governor device 14. Lever 7 is supported near its midpoint by a fulcrum so as to effect counterclockwise rotation of rotary member 9 when piston 4 is actuated, while conversely governor device 14 effects clockwise rotation of rotary member 9 as its flyballs are thrown outwardly by centrifugal force with increased engine speeds, thereby providing a feedback of the engine speed to regulate the throttle setting. Also connected to rotary member 9 is the slider arm 15 of a potentiometer 16.

The slave engine controls shown within block 2 are identicle to the master engine controls, with like parts being identified by a corresponding number having a prime mark.

Conduit 5' leading to fluid motor 3' of the slave engine controls is connected to the delivery port **5*a* of a conventional self-lapping or graduated type relay valve device 17, whose output pressure is derived from a compressed air supply conduit 18 that is connected to supply port 18*a* in accordance with the pilot pressure effective in a conduit 19 that is connected to a control port 19*a***.

Conduit 19 is connected between a two-way, solenoid operated spring released pneumatic supply valve 20 and exhaust valve 21 comprising an electro-pneumatic converter.

The supply valve solenoid is connected to the cathode terminal of a thyrister 22 whose anode terminal is connected to a source of power in parallel with the contacts 23 of a reed relay. The thyrister gate terminal 24 is connected to the source of power via the reed relay contacts 23, which are controlled by an electromagnet 25 that is connected to the output of an operational amplifier 26 via a diode 27. Input 28 of operational amplifier 26 is connected to the slider arm 15 of potentiometer 16, while input 29 is connected to slider arm 15' of potentiometer 16'.

An electro-magnet 30 is connected to the output of operational amplifier 26 via a diode 31 and controls the contacts 32 of a reed relay. These contacts 32 control the flow of current to the gate terminal 33 of a thyrister 34 whose cathode terminal is connected to the solenoid of exhaust valve 21.

During operation, the master engine controls as well as the slave engine controls can be assumed to be in a balanced condition in which the engine fuel rack or throttle is set to maintain a certain engine speed as long as a steady state condition prevails, i.e., neither the load demand nor speed command change.

In the event the speed control signal in the form of pneumatic pressure in conduit 5 is increased, the master engine fluid motor 3 increases the compression of control spring 6 to actuate rod 8 against the counteracting force of governor device 14. This action results in counterclockwise rotation or rotary member 9 to increase the engine fuel rack setting and accordingly increase engine speed. As the engine speed increases, the speed governor action increases its counteracting force on rod 8, consequently pulling back somewhat on the fuel rack setting until a new balanced state exists at a higher engine speed as called for by the speed control signal.

A similar action results in the event the master engine load condition changes. For example, an increased load will reduce the engine speed momentarily, causing governor device 14 to reduce its counteracting effect on rod 8, such that rotary member 9 is rotated in a counterclockwise direction. The fuel rack setting is accordingly increased to bring the engine speed back into correspondence with the speed control signal in effect.

In either case, a change in the master engine throttle or fuel rack setting occurs, such change being sensed by operational amplifier 26 in the form of a voltage increase at its input 28, as detected by potentiometer 16. In this sense, the operational amplifier is used as a comparator, providing a positive voltage when the voltage at input terminal 28 exceeds the voltage at input terminal 29. Diode 27 thus conducts current to the electromagnet 25, while diode 31 blocks current flow to electro-magnet 30. Energization of electro-magnet 25 closes the red relay contacts 23 to provide a control signal at gate terminal 24 of thyrister 22, which conducts current to the solenoid of supply valve 20.

In the energized condition of supply valve 20, a communication is established between conduits 18 and 19. Compressed air supplied from conduit 18 thus builds up in conduit 19, since its communication with atmosphere via exhaust valve 21 is cut off in the deenergized condition of its solenoid, as shown. The build-up of pressure in conduit 19 is connected to the control port **19*a* of relay valve device 17, which responds in a well known fashion to connect compressed air from supply port 18*a* to the relay valve delivery port 5*a* to which conduit 5'** is connected.

The resultant build-up of pressure in conduit 5' actuates fluid motor 3' to adjust the position of the slave engine fuel rack setting in a manner as previously explained with reference to the master engine controls. The slave engine fuel rack setting is adjusted to increase engine speed, while concurrently potentiometer 16' detects the change in the fuel rack setting and accordingly increases the voltage at input terminal 29 of operational amplifier 26. When the effective voltage at input terminal 29 matches the voltage at input terminal 28, the operational amplifier output goes to zero, deenergizing electro-magnet 25 and accordingly breaking the gating circuit to thyrister 22 via the reed relay contacts 23. Conduction of thyrister 22 is thus terminated to deenergize the solenoid of supply valve 20, which accordingly cuts off communication between supply conduit 18 and conduit 19 to trap the existing relay valve control pressure at a value corresponding to a point at which fluid motor 3 adjusts the slave engine fuel rack to match the setting of the master engine fuel rack.

From the foregoing, it will be seen that due to the near instantaneous response of the electronic components via which the pneumatic pressure to the slave engine fluid motor 3' is controlled, the slave engine fuel rack setting is adjusted to match any change in the setting of the master engine fuel rack prior to the master engine governor device responding to a speed change to further regulate the fuel rack setting in the well known manner. This assures that any change in the master engine throttle can be quickly duplicated by the slave engine controls before the engine governor exerts any influence on its throttle. Subsequent to synchronization of the slave engine throttle setting with the master engine throttle, the respective engine speed governors will respond in substantial unison to regulate the engine speed. Since a common load is connected to the master and slave engines, the degree of speed regulation by the respective speed governors can be expected to be substantially the same, so that each engine shares equallly in driving the common load.

In the event the speed control signal at conduit 5 is decreased, piston 4 of fluid motor 3 is correspondingly retracted, relieving the degree of compression of control spring 6 to upset the balanced forces on rod 8 such as to effect rotation of member 9 in a clockwise direction. This reduces the engine throttle setting, which is monitored by potentiometer 16. The potentiometer voltage at input 28 of operational amplifier 26 drops below the slave engine potentiometer voltage at terminal 29, thus forcing the operational amplifier output into a negative state. Diode 31, in this case becomes conductive, while diode 27 blocks, in order to energize the solenoid of exhaust valve 21 via electro-magnet 30, reed relay contacts 32 and thyristor 34. In its energized state, exhaust valve 21 vents the compressed air trapped in conduit 19, which in turn causes relay valve device 17 to correspondingly reduce pressure in conduit 5'. When the reduction of pressure in conduit 5' is such as to effect a reduction in the slave unit throttle setting corresponding to the master unit throttle, the operational amplifier output will become zero by reason of the voltage potential at its inputs being the same, thereby terminating any further reduction of pressure in conduit 5'.

It will now be apparent that either an increase or decrease in the master engine throttle setting can be duplicated quickly and accurately by the slave engine controls in accordance with the arrangement of the present invention, so that each engine produces approximately equal torque at its output shaft to which a common load is connected.

Having now described the invention, what we claim as new and desire to secure by Letters Patent, is:

1. A control system for operating a master engine and a slave engine having a common load, said control system comprising:

(a) throttle means associated with eahc engine for varying the engine speed;

(b) actuator means associated with each engine for setting said throttle means thereof in accordance with a speed control signal supplied to said actuator means thereof;

(c) speed governor means associated with each engine and operative responsive to variations in the engine speed for counteracting said actuator means accordingly;

(d) means associated with each engine for detecting the setting of said throttle means thereof; and (e) control means for providing said slave engine a speed control signal in accordance with the difference between the setting of said master and slave engine throttle means.

2. A control system as recited in claim 1, wherein:

(a) said throttle setting detector means is a potentiometer; and (b) said control means includes:

(i) an electronic comparator having one input connected to the output of said master engine potentiometer, another input connected to the output of said slave engine potentiometer and an output providing said slave engine speed control signal; and (ii) electro-pneumatic conversion means for connecting said slave engine speed control signal to said actuator means of said slave engine.

3. A control system as recited in claim 2, wherein said actuator means comprises:

(a) a fluid pressure motor subject to said speed control signal; and (b) a control rod operatively connected between said fluid pressure motor and said speed governor means, said control rod being connected to said throttle means to adjust the setting thereof.

4. A control system as recited in claim 3, further characterized in that said speed governor means is connected to said control rod such as to urge movement thereof in a direction to counteract adjustment of said throttle means by said fluid pressure motor.

5. A control system as recited in claim 4, wherein said actuator means further comprises a control spring acting between said fluid motor and said speed governor means.

6. A control system as recited in claim 2, wherein said electro-pneumatic conversion means comprises:

(a) a solenoid operated, pneumatic supply valve having a supply port to which a source of fluid pressure is connected and a delivery port communicated with said supply port in response to energization of the solenoid operator; and (b) a solenoid operated, pneumatic exhaust valve having a supply port to which the delivery port of said supply valve is connected via a control conduit and a delivery port communicating said supply port of said exhaust valve to atmosphere in response to energization of the solenoid operator thereof.

7. A control system as recited in claim 6, wherein said conversion means further comprises a self-lapping relay valve device having a supply port connected to said source of fluid pressure, a control port connected to said control conduit, and a delivery port connected to said slave engine actuator means to provide said control signal therefor.

8. A control system as recited in claim 6, wherein said control means further comprises:

(a) a first circuit for energizing said supply valve solenoid including:

(i) first thyristor means in circuit between a source of electrical power and said supply valve solenoid;

(ii) first reed relay contacts in circuit between the source of electrical power and a gate terminal of said first thyristor;

(iii) first electro-magnetic means for effecting closure of said first contacts when energized; and (iv) a first diode arranged in circuit between the output of said electronic comparator adn said first electro-magnetic means to effect energization thereof when the output of said comparator becomes positive responsive to said one input thereof being greater than said another input thereof; and (b) a second circuit for energizing said exhaust valve solenoid including:

(i) second thyristor means in circuit between a source of electrical power and said exhaust valve solenoid;

(ii) second reed relay contacts in circuit between said source of electric power and a gate terminal of said second thyristor;

(iii) second electro-magnetic means for effecting closure of said second contacts when energized; and (iv) a second diode arranged in circuit between the output of said electronic comparator and said second electro-magnetic means to effect energization thereof when the output of said comparator becomes negative responsive to said one input thereof being less than said another input thereof.

* * * * *